United States Patent [19]

Nowicki

[11] Patent Number: 4,690,395

[45] Date of Patent: Sep. 1, 1987

[54] LABEL MAGAZINE

[75] Inventor: Casimir W. Nowicki, Sylvania, Ohio

[73] Assignee: Owens-Illinois, Inc., Toledo, Ohio

[21] Appl. No.: 841,650

[22] Filed: Mar. 20, 1986

[51] Int. Cl.[4] ..... B65H 3/14

[52] U.S. Cl. ..... 271/98; 271/105; 271/31.1; 271/169; 221/310

[58] Field of Search ..... 221/198, 227, 232, 278, 221/310, 307; 271/97, 98, 105, 31.1, 169, 170

[56] References Cited

U.S. PATENT DOCUMENTS

| | | | |
|---|---|---|---|
| 1,587,417 | 6/1926 | Reyes | 271/31.1 |
| 1,982,823 | 12/1934 | Meredith | 271/31.1 |
| 2,282,224 | 5/1942 | Harrold | 271/98 |
| 3,655,181 | 4/1972 | Paulson | 271/98 |
| 3,655,182 | 4/1972 | Rilinger | 271/170 |
| 3,893,663 | 7/1975 | Sanchez et al. | 271/169 |
| 4,059,193 | 11/1977 | Ryumon et al. | 271/31.1 |
| 4,358,102 | 11/1982 | Hoshizaki et al. | 271/169 |

*Primary Examiner*—Joseph J. Rolla
*Assistant Examiner*—Kenneth Noland
*Attorney, Agent, or Firm*—Howard G. Bruss

[57] ABSTRACT

A label magazine comprising a tray for supporting a stack of labels and having a device at one end for yieldingly urging the labels toward the other end of the tray and a plurality of circumferentially spaced spring fingers positioned at the other end of the tray about the labels, each finger including an axially extending portion and an inwardly extending portion engaging the outermost label of the stack. Each finger is mounted so that it can be adjusted to move the finger inwardly of the label and accomodate variations in the size of the labels.

6 Claims, 6 Drawing Figures

LABEL MAGAZINE

This invention relates to label magazines and particularly to label magazines that are utilized for holding labels which are picked up and delivered for use on containers.

BACKGROUND AND SUMMARY OF THE INVENTION

In the handling of labels, it has been common to provide a magazine holding a stack of labels so that the outermost label can be removed. Such magazines are particularly useful for holding labels for containers. Where the magazine is used to hold a stack from which labels are removed at rapid rates, as where the labels are delivered to the cavities of a mold and plastic parison is blown outwardly so that the label becomes part of the final container, it is necessary that the magazine hold the labels in position for rapid delivery as by being picked up by vacuum cups. Moreover, the labels may vary slightly in size and it is desirable to make fine adjustment in the magazine.

Accordingly, among the objectives of the invention are to provide a label magazine which effectively supports labels and is simple in constructing mechanism for supporting and delivering the labels and which can be readily adjusted for labels of varying tolerances.

In accordance with the invention, a label magazine comprising a tray for supporting a stack of labels and having a device at one end for yieldingly urging the labels toward the other end of the tray and a plurality of circumferentially spaced spring fingers positioned at the other end of the tray about the labels, each finger including an axially extending portion and an inwardly extending portion engaging the outermost label of the stack. Each finger is mounted so that it can be adjusted to move the finger inwardly of the label and accommodate variations and the size of the labels.

DESCRIPTION

Figure 1:
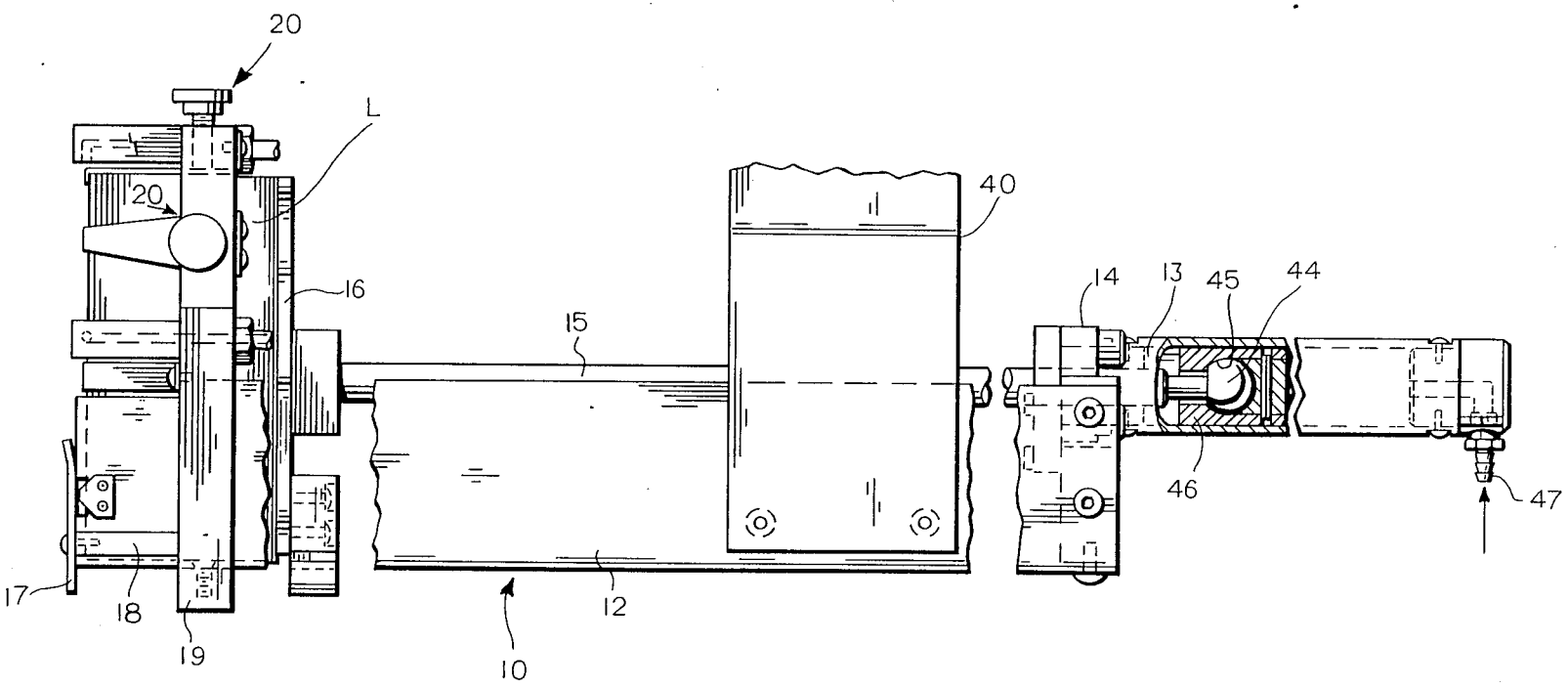
FIG. 1 is a fragmentary elevational view of an apparatus embodying the invention with the labels removed.
Figure 2:
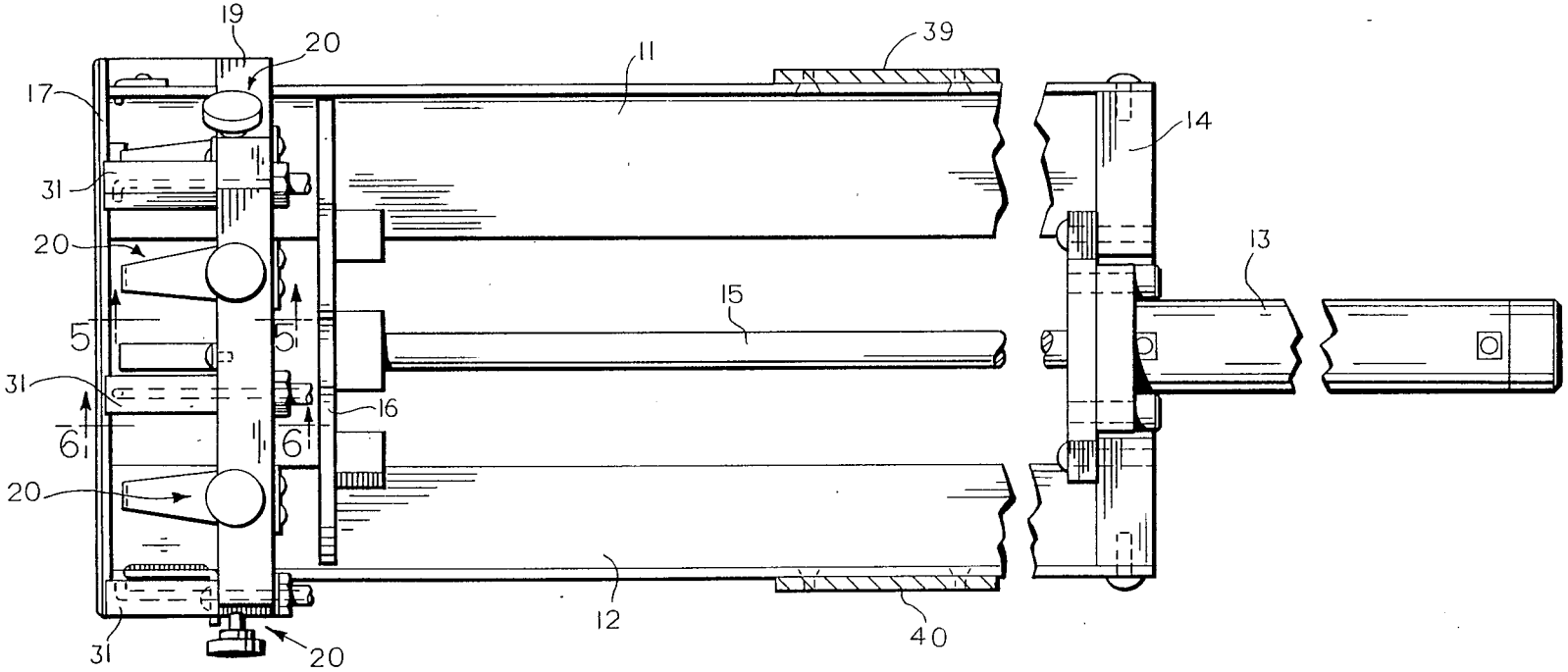
FIG. 2 is a fragmentary plan view of the apparatus.
Figure 3:
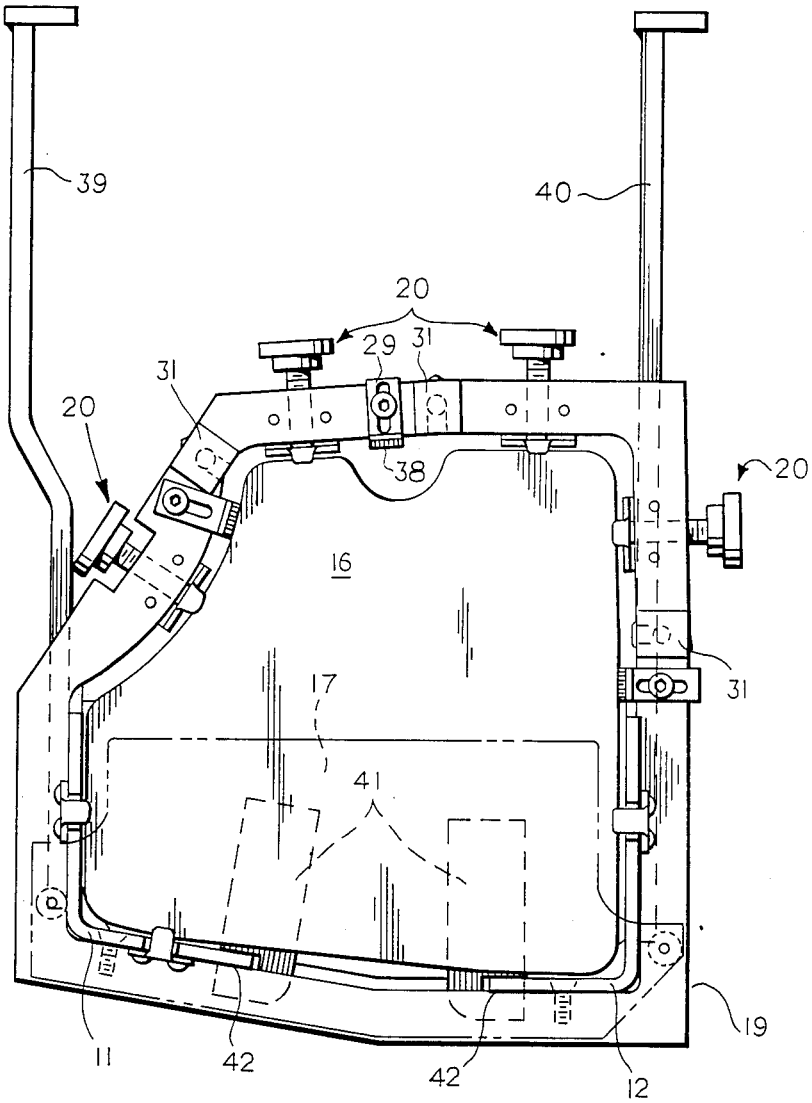
FIG. 3 is an end view of the apparatus taken from the left as viewed in FIG. 1.
Figure 4:
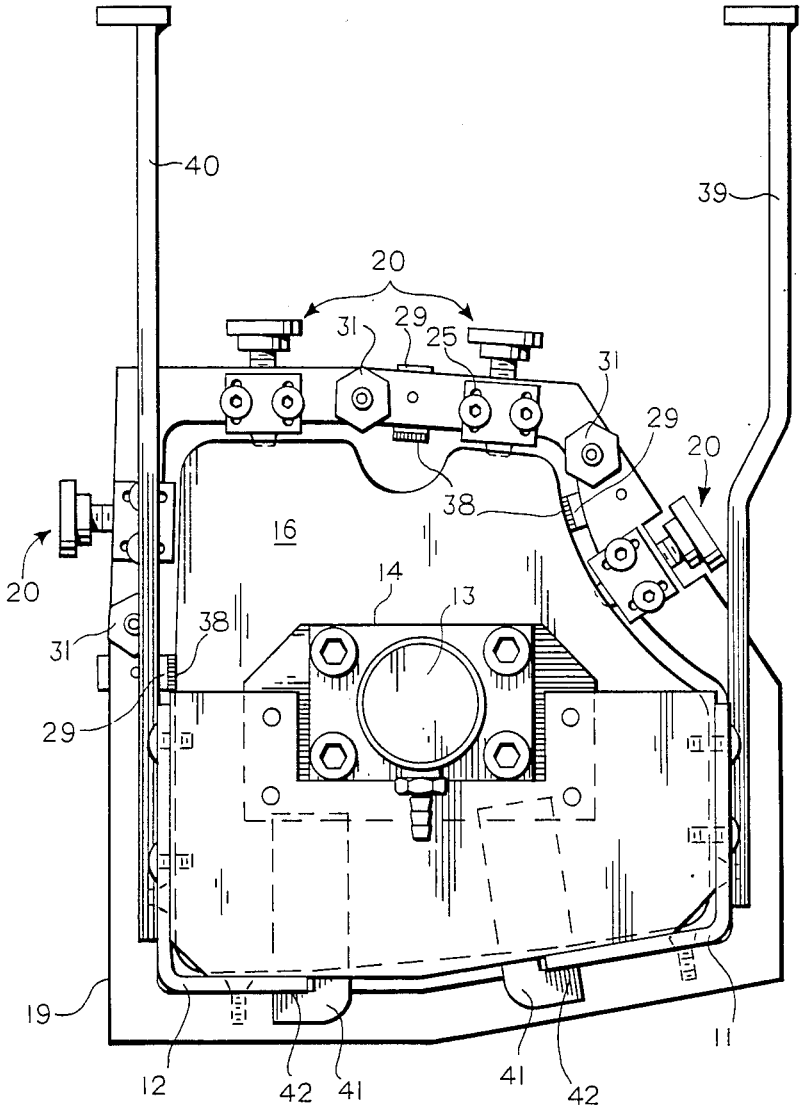
FIG. 4 is an end view of the apparatus taken from the right in FIG. 1.

Referring to FIGS. 1–4, the apparatus embodying the invention comprises a tray 10 that is formed by two L-shaped guide rails 11, 12 that support a stack of labels. At one end a pneumatic cylinder 13 is supported on a bracket 14 and has its shaft 15 supporting and yieldingly urging a pusher plate 16 against one end of the stack of labels toward the other end of the tray into engagement with a plate 17 that covers the lower part of the labels L. Plate 17 is mounted by spacers 18 on a ring 19 fixed at the other end of the tray which has the general configuration of the labels L which are to be delivered.

Figure 5:
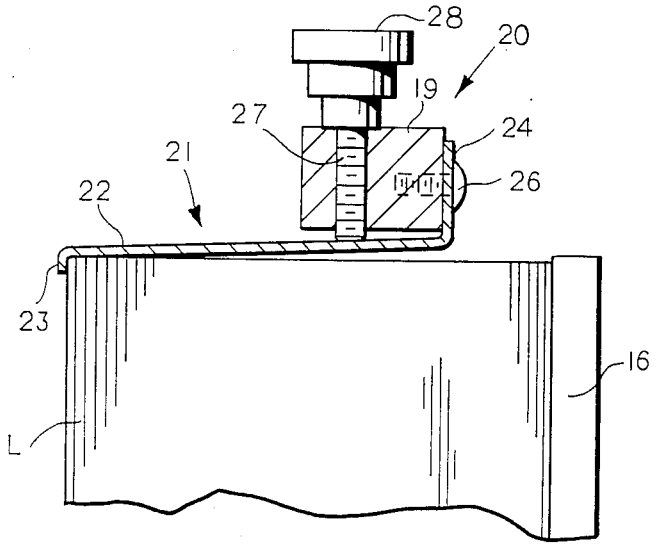
FIG. 5 is an enlarged fragmentary view on an enlarged scale taken along the line 5—5 in FIG. 2 showing the labels in position.
Figure 6:
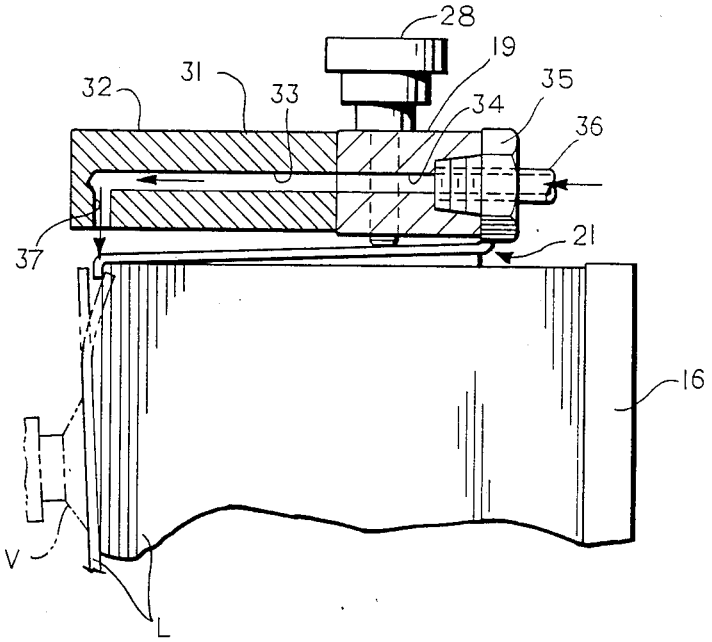
FIG. 6 is an enlarged view taken along the line 6—6 in FIG. 2, showing the labels in position.

A plurality of circumferentially spaced spring assemblies 20 are provided on the ring 19 about the periphery of the portion of the labels above plate 17 which do not engage the plate 17. Referring to FIGS. 5 and 6, each spring assembly 20 includes an L-shaped spring member 21 of spring material such as spring steel having axially extending portion 22 and a radially inwardly extending portion or tip 23 that overlies the endmost label. Each spring member 20 has a mounting flange 24 at its other end with an opening 25 which is elongated in a radial direction. A screw 26 extends through opening 25 to hold flange 24 and, in turn, the spring member in adjusted position. Each assembly 20 further includes a screw 27 that extends inwardly into engagement to the axial portion 22 of the spring member 21 to adjust the position of the spring member 21 and thereby accommodate variations in the tolerances of the labels. A knob 28 is provided on the screw 27 for adjusting the spring member 21.

In addition, a plurality of L-shaped spring fingers 29 are provided which are not adjustable and have inwardly extending portions 30. A riffling device 31 is provided adjacent each sporing assembly 20 one end of the label for directing air and facilitating the removal of a single label at a time by vacuum cup V or the like. Each riffling device 31 comprises a body 32 which is mounted on ring 17 and includes a passage 33 that communicates with axial passage 34 in ring 17 that is, in turn connected by a coupling 25 to a source of an under pressure from supply line 36. A radial outlet passage 37 extends from passage 33 radially inwardly to direct air against the adjacent edge of the outermost labels L. Each flange 29 supports a looped pile pad 38, such as a Velcro pad, to tend to hold the outermost labels against which air is blown, spaced apart to facilitate further the removal of a single label.

Hangers 39, 40 are fixed to the ring 17 by screws for supporting the tray 10 in any desired position. The tray rails 11, 12 are fixed at one end on the bracket 14 by screws and at the other end on ring 17 by screws. Slide guides 41 are mounted on pusher plate 16 by screws and have slots 42 engaging the horizontal leg of each rail 11, 12.

Referring to FIG. 1, cylinder 13 is constructed to accommodate lateral movement of the shaft 15 by having a ball 44 on the inner end of shaft 15 which engages a spherical seat 45 in a piston 46. Air supplied under pressure through inlet 47 urges piston 46 and shaft 15 and the associated plate 16 in a direction to hold the labels against the spring members against plate 17 thus accommodating lateral movement of shaft 15.

As indicated in the drawings, the various parts are preferably attached to the ring by screws to obviate the tendency to distortion that might occur if welding were used.

I claim:

1. A label magazine comprising a tray for supporting a stack of labels, means at one end of said tray for yieldingly urging the labels toward the other end of the tray and, a plurality of circumferentially spaced spring members positioned at the other end of the tray about the labels, each member including an axially extending portion and a radially inwardly extending portion engaging the outermost label of the stack, means for mounting each member so that it can be adjusted to move the member inwardly and outwardly of the label and accommodate variations of the labels said means yieldingly urging said labels comprising a pusher plate, a rod fixed to said plate and fluid operated means yieldingly urging said rod and plate and permitting limited relative radial movement of said plate, said fluid operated means comprising a cylinder to which fluid is applied, a piston in said cylinder and having a spherical seat, said rod having a ball engaging said seat in said piston.

2. A label magazine comprising a ring, a tray for supporting a stack of labels, said labels have corners, said tray comprising spaced longitudinally extending L-shaped rails fixed to said ring and adapted to an edge and engaging the corners of a stack of labels and forming the sole support for the labels, said ring having the general configuration of a label, means at one end of said tray for yieldingly urging the labels toward the other end of the tray and, a plurality of circumferentially spaced spring members mounted on the ring at the other end of the tray about the labels, each member including an axially extending portion and a radially inwardly extending portion extending from one end of said axially extending portion and engaging the outermost label of the stack, means for mounting the other end of said axially extending portion of each member.

3. The label magazine set forth in claim 2 wherein said L-shaped rails comprise legs, said means for urging said labels toward the other end comprises a pusher plate, said pusher plate having a slot therein individual to each L-shaped rail and engaging one of the legs of its respective L-shaped rail for guiding the pusher plate.

4. The label magazine set forth in claim 1 wherein a plurality of secondary members are provided on said ring at the periphery of the labels, each secondary member being made of spring material and having an axial portion of lesser axially extent that the first mentioned spring members having opposite ends and a inwardly extending portion extending from one end of said axially extending portion and overlying the endmost label and means for mounting the other end of said axially extending portion of each secondary member.

5. The label magazine set forth in claim 2 wherein said means yieldingly urging said labels comprises a pusher plate, a rod fixed to said plate and fluid operated means yieldingly urging said rod and plate and permitting limited relative radial movement of said plate, said fluid operated means comprises a cylinder to which fluid is applied, a piston in said cylinder and having a spherical seat, said rod having a ball engaging said seat in said piston.

6. A label magazine comprising a tray for supporting a stack of labels, means at one end of said tray for yieldingly urging the labels toward the other end of the tray and, a plurality of circumferentially spaced spring members positioned at the other end of the tray about the labels, each member including an axially extending portion and a radially inwardly extending portion engaging the outermost label of the stack, means for mounting each member can be adjusted to move the member inwardly and outwardly of the label and accommodate variations of the labels said means yieldingly urging said labels comprising a pusher plate, a rod fixed to said plate and fluid operated means yieldingly urging said rod and plate and permitting limited relative radial movement of said plate, said fluid operated means comprising a cylinder to which fluid is applied, a piston in said cylinder and having a spherical seat, said rod having a ball engaging said seat in said piston, said fluid operated means comprising a cylinder to which fluid is applied, a piston in said cylinder and having a spherical seat, said rod having a ball engaging said seat in said piston.

* * * * *